United States Patent [19]

Van Becelaere

[11] Patent Number: 4,515,068

[45] Date of Patent: May 7, 1985

[54] DAMPER WITH INTEGRAL MOUNTING MEANS

[75] Inventor: Robert M. Van Becelaere, Johnson County, Kans.

[73] Assignee: Ruskin Manufacturing Company, Grandview, Mo.

[21] Appl. No.: 500,285

[22] Filed: Jun. 1, 1983

[51] Int. Cl.[3] ..... F24F 7/00

[52] U.S. Cl. ..... 98/1; 126/287.5; 126/318; 285/189

[58] Field of Search ..... 126/285 R, 287.5, 312, 126/314–317, 318; 160/1.5, 235; 285/189, 186, 404; 137/73, 74, 75; 98/101.1, 86, 40 R, 40 B

[56] References Cited

U.S. PATENT DOCUMENTS

| | | | |
|---|---|---|---|
| 569,165 | 10/1896 | Bostwick | 126/314 |
| 789,936 | 5/1905 | Reed | 126/318 |
| 1,225,795 | 5/1917 | Fraser | 285/189 |
| 3,327,764 | 6/1967 | McCabe | 160/5 |
| 3,467,163 | 9/1969 | Vassaux | 137/75 |
| 4,411,458 | 10/1983 | Strunk et al. | 285/186 |

FOREIGN PATENT DOCUMENTS

| | | | |
|---|---|---|---|
| 133908 | 10/1919 | United Kingdom | 285/189 |

*Primary Examiner*—James C. Yeung

*Attorney, Agent, or Firm*—Kokjer, Kircher, Bradley, Wharton, Bowman & Johnson

[57] ABSTRACT

A fire damper with mounting structure which permits the dampers easy installation in a building ventilation duct or passage without the use of conventional, external flanges which must be bolted on at the installation site. The damper includes a peripheral frame having internally threaded, tubular elements secured to the inside of the frame and aligned with apertures extending through the frame. Threaded studs in the elements have self-boring, conical noses so that the studs may be advanced into gripping engagement with the proximal building wall.

1 Claim, 4 Drawing Figures

Fig. 1.
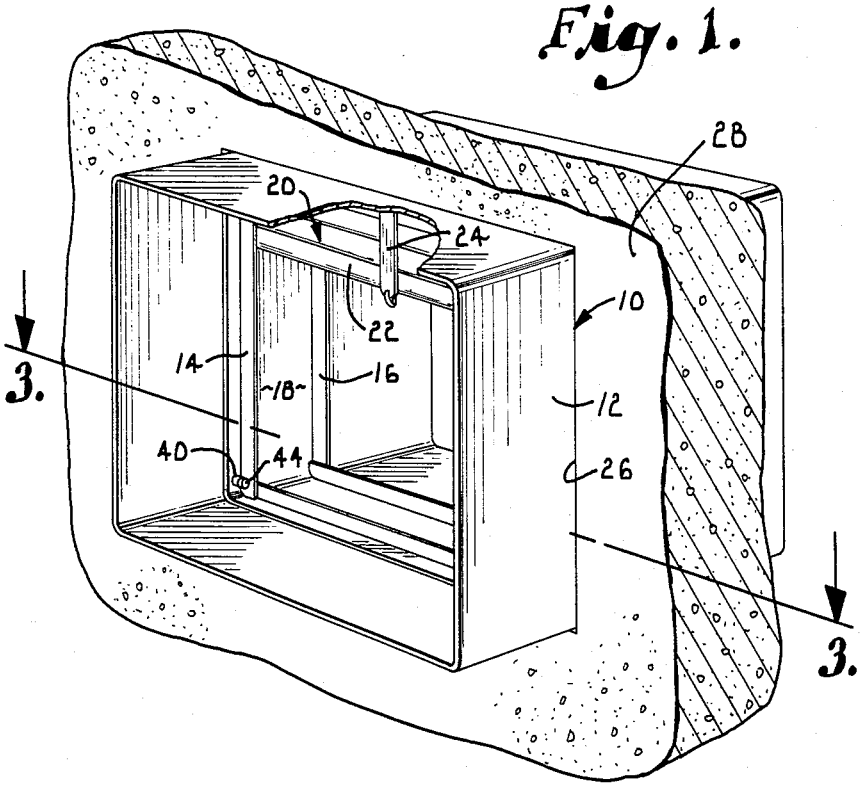
Fig. 2.
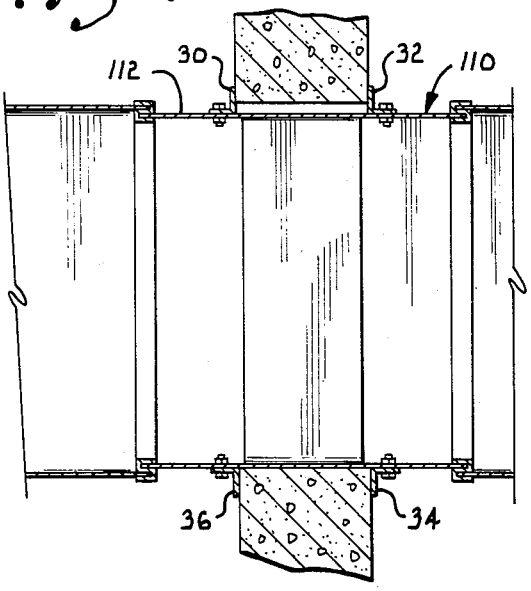
PRIOR ART
Fig. 3.
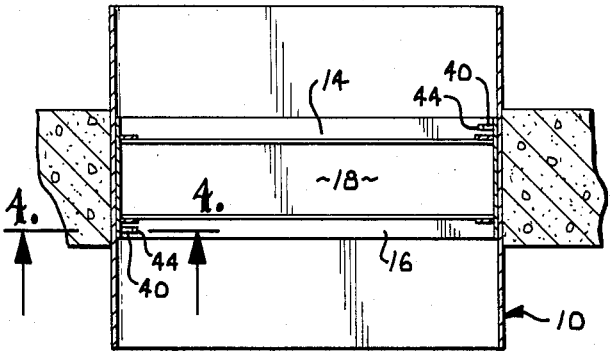
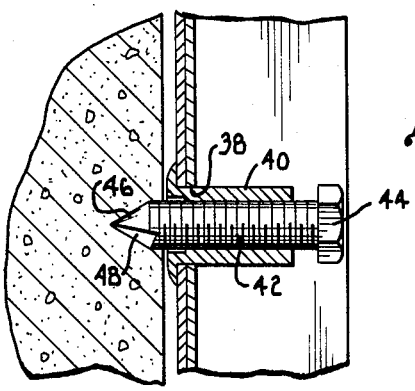
Fig. 4.

DAMPER WITH INTEGRAL MOUNTING MEANS

This invention pertains to dampers to control the flow of air or gases through passages such as the dampers which are interposed in building passageways or ducts for protection in the event of fire.

Dampers of this kind are required by building codes at prescribed intervals in most buildings. Certain zones of the building are typically isolated from other zones by fire retardant walls and the like to assist in the control of fire in the building. Passages through the fire wall which cannot be physically closed during normal use of the building, such as air conditioning and heating ducts, for example, are provided with protective dampers of this type. The dampers normally remain in standby condition to permit fluids to flow through the building. In the event of an outbreak of fire, these dampers automatically operate to close the fluid flow through the passage.

Many building codes require or customers insist that these emergency protective devices and the mode of their installation in the building be certified by an appropriate testing organization. One of the tests deemed relevant by one or more of the principal testing organizations concerned with such matters involves the application of a stream of water under high pressure against the tested device when the latter has been subjected to a predetermined amount of heat from a fire for a predetermined length of time. Such streams are used to simulate the explosive forces associated with a fire and the test is designed to insure that a stream from a fire hose would not destroy the effectiveness of the damper.

It has heretofore been generally accepted that means which might otherwise be utilized to fasten the dampers in the building wall openings are inadequate for this purpose. The relatively severe requirements of the fire rating tests wherein the installed dampers must withstand a very substantial; directly applied force for a sustained period of time has resulted in the use of relatively cumbersome systems for fastening the dampers in the passageways. Typically, flanges are bolted to the damper frame on both sides of the damper so that the extending flanges prevent dislodgement from forces against the damper from either direction.

Since the damper often must be telescoped through the passageway and mated with the ends of proximal ductwork, it is usually not possible to install the flanges until after the damper is positioned in its final location. The installation of these mounting flanges at the job site has been tedious and time consuming. This results in a substantial increase in the cost of construction and, when one considers the great number of dampers required in but a single building, this increased cost is highly significant.

Applicant has discovered a mode of fastening dampers of this type which is capable of passing relevant inspection organization tests of the type herein mentioned, yet which can eliminate the requirement for the use of the conventional mounting flanges heretofore used for this purpose. Accordingly, it is a primary object of the present invention to provide a reliable fastening means for dampers of this type which may be quickly and easily installed at the job site by ordinarily skilled workmen without the necessity for the use of tools other than those commonly and readily available.

In the achievement of the foregoing object, it is an object of this invention to provide a damper fastening means which is substantially more economical in both materials and in field labor than the fastening means presently in widespread use.

A further object of the invention is to greatly simplify the procedure by which dampers are installed in buildings through the use of novel fastening structure for this purpose without sacrificing the reliability of the unit to remain in proper position under the rigorous conditions expected to be encountered in a fire.

A further object of the invention is to provide a simplified fastening means for dampers of this type, which means is well suited for economical attachment to the damper during factory assembly, thereby increasing the economies to be realized through use of the principles of the invention.

These and other important aims and objectives of the present invention will be further explained, or will become obvious from the following specification and descriptions of the drawings, wherein:

FIG. 1 is a fragmentary, perspective view of a building fire wall showing a damper embodying the principles of this invention installed in a building passageway, parts being broken away to reveal details of construction;

FIG. 2 is a fragmentary, detailed horizontal cross-sectional view through a building fire wall and ventilation duct showing a damper installed with conventional flanges;

FIG. 3 is a detailed cross-sectional view taken along line 3—3 of FIG. 1; and FIG. 4 is an enlarged, fragmentary, detailed, vertical cross-sectional view through a damper showing one of the fasteners embodying the principles of the present invention.

A fire and smoke damper constructed pursuant to the principles of this invention is broadly designated by the reference numeral 10 and includes a peripherally extending frame 12 which may advantageously be of substantially one piece sheet metal construction. Pairs of parallel, elongated angle members 14 and 16 are secured to the inner surface of frame 12 as shown clearly in FIG. 1 with the inwardly projecting flanges of the angle members defining therebetween a track 18 for a barrier 20. Barrier 20 may typically comprise a plurality of rigid, elongated sections 22 hingedly interconnected along their respective adjacent longitudinal edges so that they may be folded to a standby position as illustrated in FIG. 1. Often the barrier is biased toward the closed position by spring means (not shown). The folded barrier sections 22 are retained in the standby position by some form of retainer incorporating a fusible link 24. The latter is constructed of elements interconnected with euctectic solder having a critical melting point calculated to melt and release the barrier when the ambient temperature reaches a predetermined level. Obviously, under such conditions the barrier is drawn to its closed position to prevent the flow of fluids such as heated air, smoke and the like through the passage.

Frame 12 often is formed of material of sufficient width to comprise a sleeve which may be telescoped partially through an opening such as 26 in wall 28. The building ventilation ducts are typically in communication with and secured to the opposed ends of the frame or sleeve. The damper 10 thus becomes a standby protective device which is capable of operating to close the ventilation passage through the wall in the event of a fire in the building.

FIG. 2 of the drawing illustrates the conventional method of fastening dampers of this type in a wall. The damper 110 of FIG. 2 has a plurality of elongated angles 30, 32, 34 and 36 bolted to the outer surface of the damper frame 112 so that the projecting leg or web of each respective angle member physically abuts a corresponding side of the wall to secure the damper in its installed position in the wall opening.

Referring now to FIGS. 3 and 4, applicant has discovered that the angle members 30, 32, 34 and 36 can be dispensed with by the provision of one or more shiftable abutment means carried by the frame itself and adapted to be moved into and out of physically engaging relationship with the wall at the wall opening. To this end, an aperture 38 is provided in the frame and preferably through the leg of angle members 14 and 16 extending parallel with the frame at the location of the aperture. An elongated, tubular, internally threaded element 40 is mounted in axially alignment with the aperture and secured to the frame. A threaded stud 42 preferably having a hexagonal head 44 is threadably received in element 40 so that the stud may be rotated to advance the latter into projected relationship from the frame. The nose 46 of stud 42 is preferably pointed or conical in shape with a cutting notch 48 in the manner well known for self-drilling screws and the like. Accordingly, rotation of the stud not only projects nose 46 from the frame but also cuts a recess in the wall to ensure that the stud can be advanced into secure engagement with the wall. The head 44 of the stud is adapted to receive a tool such as a wrench to provide the installing workman with the necessary mechanical advantage to ensure a good solid installation with the stud projecting sufficiently into the wall that the damper is secure from dislodgement.

It will ordinarily be desirable that a plurality of fasteners be provided at peripherally spaced locations around the frame. Actually, it has been found that two such fasteners, one on either side of the frame is ordinarily adequate for this purpose. The arrangement illustrated in FIG. 3, for example, wherein one fastener is on the opposite side of the frame and the opposite side of the barrier track from the other fastener is considered ideal for a concrete or brick wall of the type illustrated in the drawing. Obviously, other arrangements of the fasteners with respect to the damper frame may be provided as required.

It has been found that dampers equipped with fasteners of the type described and installed as illustrated are adequate to resist the rigorous test procedures devised for commonly recognized testing laboratory approval for devices of this kind. Those skilled in the art will recognize that the apertures 38 might simply be internally threaded and the studs 42 engaged therein. However, since the frame of the damper is preferably formed of relatively thin sheet material, it has been found desirable to install the tubular elements 40. These elongated elements provide more threaded contact between the element and its stud than could be provided in the sheet material alone.

The elements 40 may be secured to the damper frame material by use of any of a wide variety of suitable attaching methods. The element 40 chosen for illustration as representative of a preferred method comprises a commercially available internally threaded tubular rivet insert wherein the head is formed on the element by deformation of the element material after its installation in the frame aperture. The methods and apparatus for installing these items in materials of various kinds are well known to those skilled in the art and need not be more completely described herein.

The pre-installation of the elements and the studs on the frames at the factory completely eliminate the necessity for the cumbersome attachment of the mounting flanges to the damper at the job site. One workman can install a great many more dampers equipped with fasteners of the type herein described than could be installed if he were required to utilize the conventional flanges. The economies effected in this manner, when multiplied by the great many dampers required for adequately protecting the ventilation system of modern buildings, are enormous.

Tests duplicative of those established by a leading testing laboratory of equipment of this type for obtaining the desired fire rating for the dampers have shown that the structure of this invention is highly reliable in service. Thus, dampers equipped with abutments of this type and used in the manner described have performed as well under even the rigorous fire hose test as some dampers equipped with conventional mounting angles.

I claim:

1. A fire damper for ready installation in a wall opening in condition to resist dislodgement by forces applied against the damper closure, said damper comprising:

a peripherally extending damper frame of sheet material adapted to fit within a wall opening in facing relationship to the wall, said frame being provided with a plurality of peripherally spaced apart apertures;

a damper closure carried by the frame and movable from a standby position permitting flow of fluids through the damper to a closed position resisting said flow;

a tubular element for each aperture respectively, each element being rigidly secured to the frame and projecting inwardly therefrom, each element being provided with a threaded bore; and an elongated, threaded stud for each element, each stud being telescoped in its respective element bore in threaded engagement therewith, the outwardly projecting end of each stud being substantially conical and having a cutting edge adapted to cut a hole for the stud when the latter is rotated on its longitudinal axis, the opposite end of each study being provided with a tool engageable head, whereby the respective studs may be advanced into projected relationship from the frame and into holes bored in the wall by the studs upon manual rotation of the respective studs on their longitudinal axes, to firmly secure the damper in the wall opening.

* * * * *